US007191845B2

(12) United States Patent
Loar

(10) Patent No.: US 7,191,845 B2
(45) Date of Patent: Mar. 20, 2007

(54) SELF-CLOSING VENT

(76) Inventor: Ronald J Loar, 2315 Rose St., Berkeley, CA (US) 94708

( * ) Notice: Subject to any disclaimer, the term of this patent is extended or adjusted under 35 U.S.C. 154(b) by 687 days.

(21) Appl. No.: 10/269,974

(22) Filed: Oct. 15, 2002

(65) Prior Publication Data

US 2004/0069506 A1 Apr. 15, 2004

(51) Int. Cl.

| | |
|---|---|
| ***A62C 2/06*** | (2006.01) |
| ***A62C 2/00*** | (2006.01) |
| ***A62C 3/00*** | (2006.01) |
| ***A62C 39/00*** | (2006.01) |
| ***F24F 7/00*** | (2006.01) |
| ***F24F 13/08*** | (2006.01) |

(52) U.S. Cl. ..... 169/48; 169/45; 454/258; 454/357

(58) Field of Classification Search ..... 169/48, 169/49, 45; 454/309, 258, 357; 137/79
See application file for complete search history.

(56) References Cited

U.S. PATENT DOCUMENTS

| | | | | |
|---|---|---|---|---|
| 2,279,791 | A * | 4/1942 | Lamb | 169/48 |
| 3,976,825 | A | 8/1976 | Anderberg | |
| 4,093,818 | A * | 6/1978 | Thwaites et al. | 174/48 |
| 4,722,158 | A * | 2/1988 | Urdaneta | 52/316 |
| 5,957,211 | A | 9/1999 | Geuken et al. | |
| 6,256,948 | B1 | 7/2001 | Van Dreumel | |

FOREIGN PATENT DOCUMENTS

| | | |
|---|---|---|
| GB | 1500913 | 2/1974 |
| GB | 2107183 | 8/1982 |

* cited by examiner

*Primary Examiner*—Kevin Shaver
*Assistant Examiner*—Darren Gorman
(74) *Attorney, Agent, or Firm*—Lawrence R. Franklin

(57) ABSTRACT

A self-closing vent has its frame and honeycomb screen coated with an intumescent material. When affixed to an external wall or eave of a building, the vent is normally open, allowing free flow of air into and out of the building, but when exposed to the heat of a fire, such as a wildfire, the intumescent expands to close the vent, thereby preventing an external fire from entering the building.

20 Claims, 2 Drawing Sheets

SELF-CLOSING VENT

BACKGROUND OF THE INVENTION

1. Field of the Invention

This invention relates to a fire-rated, self-closing vent for soffits and walls connecting the exterior of a building to its interior. The vent comprises a screen surrounded by a peripheral frame, the combination having no moving parts. The screen comprises cells which are coated with an intumescent. Under normal conditions the cells are open to freely pass air therethrough and serves to ventilate crawl spaces, attics, etc. When subjected to the elevated temperatures of an external fire, the intumescent expands to close the cells, thus preventing flames, heat, and gaseous fumes from entering the building.

2. Description of Related Art

A major problem, especially in Southern California and other dry areas, is the occurrence of wildfires, mainly brush fires and forest fires, and the concomitant damage they do to property in their paths. Homes, offices, and other buildings are constructed and maintained so as to prevent the spread of internal fires from one room to another. Included in this effort is the use of an intumescent coated screen or grill as a self-closing vent in interior walls, floors, ceilings, or ventilation ducts, all of which provide open air-flow between rooms under normal conditions but which close when exposed to high temperatures. The patents of record are representative of the prior use of intumescent coated, self-closing vents for internal walls, ceilings, floors, and ventilation ducts. A close reading, however, reveals that they have not been applied to external walls, soffits, etc. The assumption has been that the fire is internal of the building, i.e., one that has started within the building, and the emphasis has been on containing fires within the interiors of buildings long enough for the inhabitants thereof to make their safe escape. Little attention has been given to vents connecting the exterior with the interior of buildings, probably because protecting the spread of an internal fire to the outside of a building has only a minor influence on occupants' safety. As a consequence, the protection of homes from the entrance of external fires has been largely overlooked, leaving buildings, especially homes, ready prey for an external fire. Firefighters and homeowners attempt to protect the homes in the paths of a wildfire by hosing down the roof and exterior walls with water, but all their efforts are in vain, when the fire enters through vents in the external walls and guts the building from the inside.

OBJECTS AND SUMMARY OF THE INVENTION

The present invention overcomes the difficulties described above by providing a self-closing vent designed to replace existing vents which connect the exterior of a building with its interior.

The present invention accomplishes the above by providing a self-closing vent coated with an intumescent, said self-closing vent being added to an external wall or soffit either as original equipment or as a replacement for existing vents.

It is an object of the invention to provide a self-closing vent which prevents an external fire from entering a building through vents which connect the exterior of a building with its interior.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
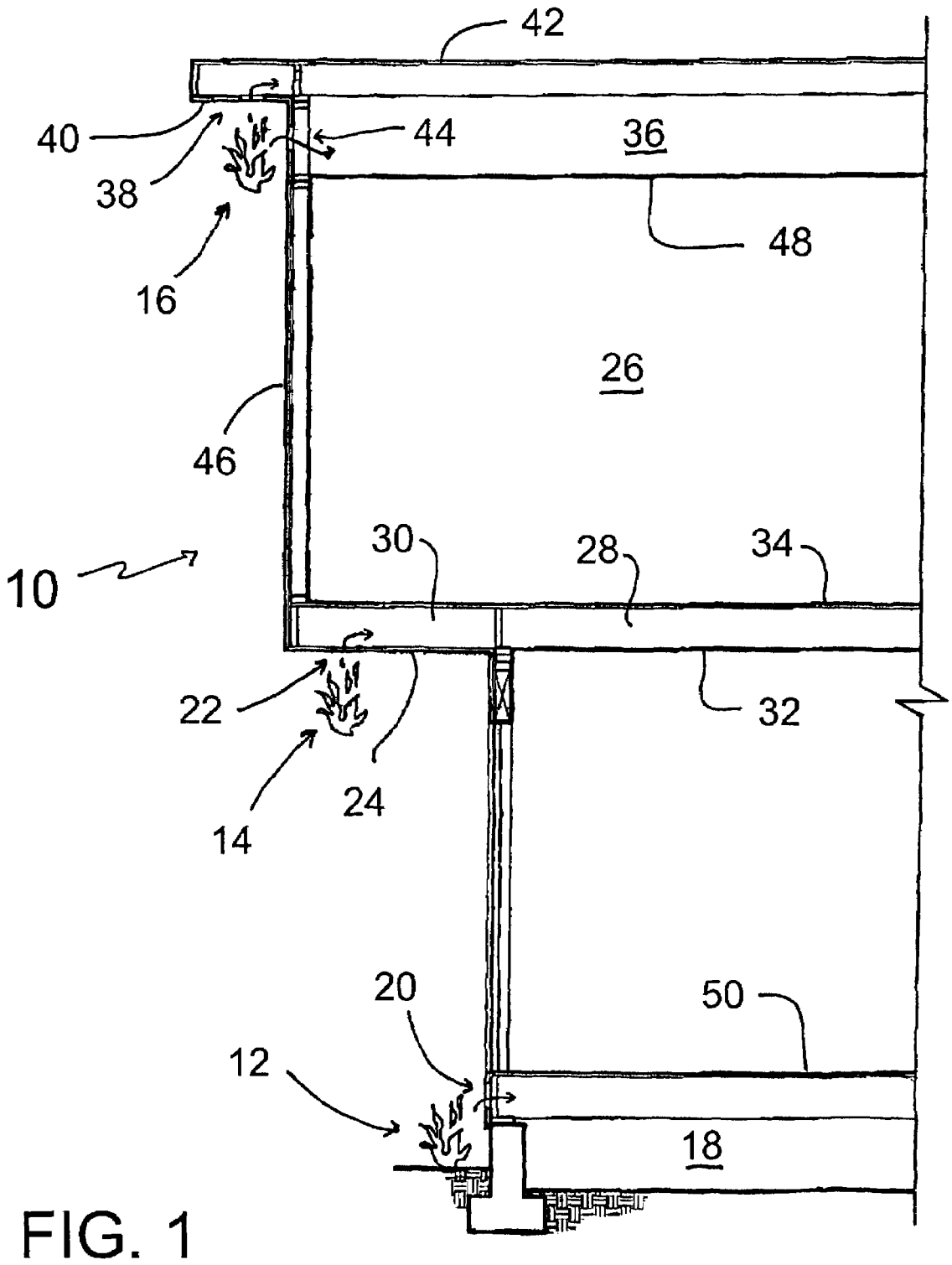
FIG. 1 is a side cross-sectional view of a building which illustrates the present invention.

Referring to FIG. 1, a diagrammatic side view in cross-section of a building 10 shows how an external fire, represented by flames 12, 14, and 16, can gain entrance into a building. Crawl space 18 includes vents 20 which allow circulation of air therethrough to prevent trapping of stale air and moisture therewithin. Soffit vents 22 through eave 24 beneath the overhang of an upper story 26 provide required venting, particularly of moisture, of joist cavities 28 formed between structural joists 30, ceiling 32, and floor 34. The accumulation of hot air in attic 36 is relieved either by soffit vents 38 in the eaves 40 of roof 42 and/or through attic vents 44 which penetrate through external walls 46 above ceiling 48. The foregoing describes common practices in the building industry.

Vents opening externally of the building are usually designed to freely promote circulation, and no thought has been given to closing them. Soffit vents 22 and 38 are often just holes formed in external siding, since being beneath the eaves 24 and 40 of an overhanging second story 26 and roof 42, respectively, they are not directly exposed to the weather. Attic vents 44 usually comprise either an open-mesh screen covering an opening into attic 36 or a plurality of fixed, overlapping louvers, if it is anticipated that the vent will be exposed to wind-blown rain or snow. All of these vents are permanently open. Crawl space vents 20 are the exception, especially in colder climates where it is desirable to have them closed during the winter months to prevent the loss of heat through floor 50. Vents 20 usually comprise vanes journalled in perimetrical frames, the vanes being rotatable from horizontally spaced to vertically overlapping. Some vents 20 comprise a pair of apertured plates, one of which is fixed while the other slides relative thereto to align or to close the apertures. Both are opened and closed mechanically, usually by hand by direct action of a human being. In the event of fires, external or internal, no one takes the time to close vents 20, and, of course, soffit vents 28 and 30 and attic vents 42 cannot be closed.

The inventor recognized that exterior vents provide unintended entries of external fires and should be automatically closed when exposed to an approaching wildfire. (Hot gasses produced by internal fires also should not be allowed to exit through the vents, for this draws fresh air into the building which feeds the fire, but that is not the primary object of this invention.) The invention is therefore directed toward vents which are designed to allow free passage of airflow through external walls under normal circumstances but to close when subjected to high temperatures as would be experienced from an external wildfire.

Figure 3:
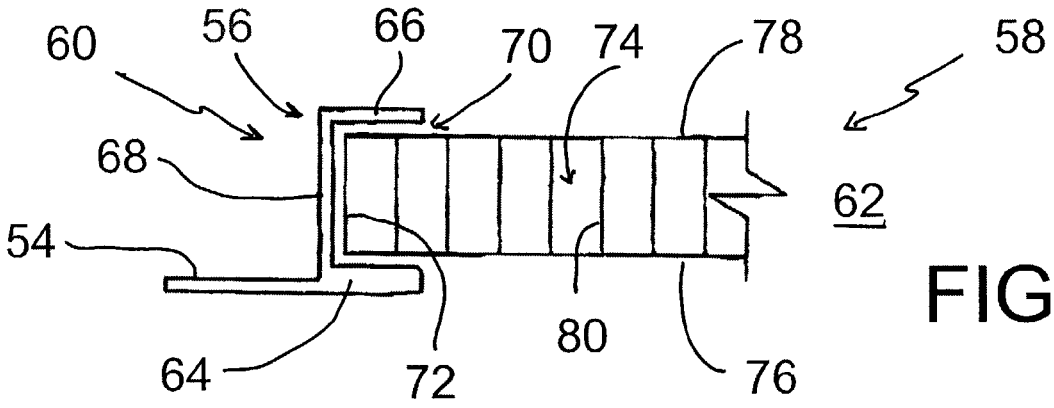
FIG. 3 is a side cross-sectional view of the disclosed embodiment as seen along lines A—A of FIG. 2.
Figure 2:
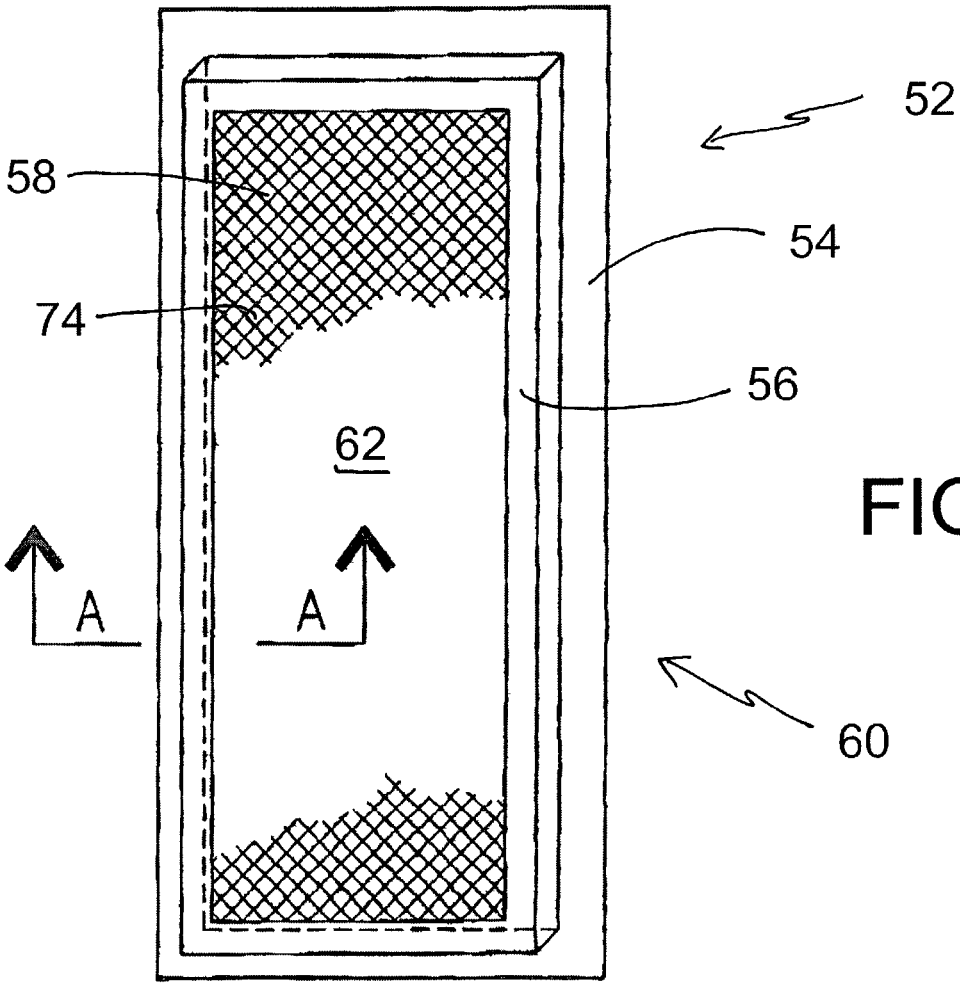
FIG. 2 is a back view of one preferred embodiment of the present invention.

Turning to FIG. 2 a perspective back view of a preferred self-closing vent 52 is shown. Vent 52 comprises two parts, a combination peripheral flange 54 and integral U-shaped body 56, and a honeycomb screen 58. Flange 54 and U-shaped body 56 combine to form a one-piece frame 60 surrounding a central opening 62. Frame 60 is shown in the shape of a rectangle, but this is for illustrative purposes only. It could be any convenient geometric or decorative figure, e.g., a square, oval, hexagon, octagon, circle, star, etc. Flange 54 is preferably made of 22 gauge galvanized sheet metal and is substantially flat (FIG. 3). U-shaped body 56 is offset relative to the plane of flange 54. That is, as seen in FIG. 3, wherein one segment of frame 60 is shown in cross-section in the direction of arrows A—A of FIG. 2, body 56 comprises a first leg 64, a second leg 66, and a web 68 connecting legs 64 and 66. The hollow interior 70 of U-shaped body 56 opens away from web 68 toward central opening 62.

In one preferred embodiment, the peripheral edge 72 of screen 58 is rigidly secured within hollow interior 70 of body 56 by any convenient means, such as by welding, brazing, or by an epoxy adhesive. In this preferred embodiment, there is no relative movement of screen 58 and frame 60, so self-closing vent 52 can be literally characterized as a rigid, integral structure with no moving parts.

Other embodiments will also fall within the scope of the disclosed invention. For instance, frame 60 could be constructed without leg 66 and with screen 58 secured either to leg 64 or web 68, or both. So long as flange 54 of frame 60 can be fastened to the external surface of wall 46 and holds screen 58 such that it covers the vent opening (not shown) in the wall, the desired results of the invention will be effected.

In the simplest construction, screen 50 is cut to shape, and frame 60 is assembled around it. In this most preferred embodiment, screen 58 is not integral with frame 60, but rather peripheral edge 72 fits loosely within hollow interior 70 of body 56 and is completely contained therein. Even though slight movement is possible between screen 58 and frame 60, vent 52 is considered for patent purposes as having no moving parts, inasmuch as any relative movement is inconsequential, producing neither a useful function nor any ill effects. Peripheral edge 72 follows the contours of frame 60 very close to web 68, so it will be appreciated that screen 58 entirely covers central opening 62 (FIG. 2).

Screen 58 preferably comprises a honeycomb structure having hexagonal cells 74 which are open through screen 58 from front 76 to back 78. Screen 58 is about ⅝th inches thick and is preferably comprised of walls 80 formed of 3 mil stock aluminum. Cells 74 are preferably substantially ¼ inch in cross-section. U-shaped body 56 completely encloses any sharp edges that peripheral edge 72 may have suffered during construction of screen 58. With frame 60 having a reasonably smooth exterior itself, vent 52 is without sharp edges, a feature which facilitates the handling, storage, and transporting thereof.

Vent 52 is coated in its entirety with an intumescent material. The coating is preferably about 10 mils thick, so it is apparent that virtually the entire width of each cell 74 is open under ambient conditions for free flow of air. When exposed to high temperatures, such as those associated with a fire, however, the intumescent material expands and carbonizes to form a solid barrier which is impenetrable by heat or by gasses.

The shape and dimensions of vent 52 will vary depending upon the intended location of use. A typical set of dimensions for vent 52 is as follows: (1) The outside dimensions of flange 54 are approximately 7.25 inches by 15.25 inches. (2) The outside dimensions of U-shaped body 56 are approximately 5.75 inches by 11.75 inches. (3) The thickness of screen 58 is approximately 0.63 inches. (4) The width of web 68 is approximately 0.69 inches. And, (5) the width of legs 64 and 66 of U-shaped body 56 is approximately 0.50 inches.

In use, for new building constructions, a vent opening is formed whereever appropriate in the external walls (the term "external wall" as used herein and in the claims incorporates any externally exposed structure, including first or second story wall 46, eaves 24 and 40, and the wall surrounding crawl space 18), and body 56 of self-closing vent 52 is fit therein. Flange 54 of frame 60 is attached to the outside surface of wall 46 around the vent opening. To retrofit self-closing vent 52 to an existing building, the building's external vents are removed, and each are replaced with a self-closing vent 52 mounted on the exterior wall or eave as before. Flange 54 is pressed flat upon wall 46 with U-shaped body 56 extending inwardly therefrom into a vent opening through the exterior wall or eave. Vent 52 is either shaped to fit an existing aperture, or a new aperture is formed having a dimension such that a standard body 56 fits snugly therewithin. Flange 54 is then fixed to the exterior wall 58 by suitable fasteners, e.g., screws, nails, etc. As is apparent from FIG. 3, flange 54 is coplanar with leg 64, so both present a smooth external surface, when flange 54 is attached flush onto an external wall. Any gaps which might exist between the external wall and vent 52 can be sealed with caulking or weatherstripping if deemed appropriate. Air will naturally flow freely through cells 74 until the intumescent material is expanded by excessive heat at which time all of the cells 74 as well as any gaps remaining between vent 52 and the exterior wall or eave of the building will be sealed by the expanded intumescent, blocking all air flow and thereby preventing access therethrough of any flames.

It is clear from the above that the objects of the invention have been fulfilled.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

I claim as my invention:

1. A self-closing venting system for preventing an external fire from entering a building through external vents, said self-closing venting system comprising in combination:

an external wall of a building, said external wall including a vent opening therethrough;

a self-closing vent, said self-closing vent comprising:

a frame, said frame defining a central opening;

a screen, said screen being contained within said frame and covering said central opening while allowing free flow of air therethrough; and the walls of said screen being coated with a layer of an intumescent material which closes said screen when subjected to the heat produced by an external fire; and said self-closing vent being mounted on said external wall to cover said vent opening.

2. The self-closing venting system of claim 1 wherein said frame comprises a peripheral flange and an integral body, said flange being substantially flat, said body being offset from the plane of said flange, and when said frame is attached to said external wall, said flange is attached to the outer surface of said external wall and said body extends into said vent opening.

3. The self-closing venting system of claim 1 wherein said screen comprises a plurality of walls defining a honeycomb structure.

4. The self-closing venting system of claim 3 wherein said plurality of walls are formed of 3 mil stock aluminum and define hexagonal cells which are open through said screen from front to back.

5. The self-closing venting system of claim 4 wherein said screen is substantially ⅝th inches thick and said hexagonal cells are substantially ¼ inch in cross-section.

6. The self-closing venting system of claim 1 wherein said vent opening extends from the exterior of said building into one of the group comprising a crawl space, a joist cavity between floors of said building, and an attic.

7. The self-closing venting system of claim 1 wherein said external wall comprises an eave and said self-closing vent is attached to a soffit.

8. The self-closing venting system of claim 1 wherein the peripheral shape of said frame comprises a decorative figure.

9. The self-closing venting system of claim 8 wherein said decorative figure comprises one of the group of rectangle, square, oval, hexagon, circle, and star.

10. A self-closing vent for preventing an external fire from entering a building through vents through an external wall, said self-closing vent comprising:

a frame, said frame defining a central opening;

a screen, said screen being contained within said frame and covering said central opening while allowing free flow of air therethrough; and the walls of said screen being coated with a layer of an intumescent material which closes said screen when subjected to the heat, produced by an external fire; and said self-closing vent being mounted on said external wall to provide free air flow between the exterior and interior of said building and to close when subjected to the heat of a fire.

11. The self-closing venting system of claim 10 wherein said frame comprises a peripheral flange and an integral body, said flange being substantially flat, said body being offset from the plane of said flange, and when said frame is attached to said external wall, said flange is attached to the outer surface of said external wall and said body extends into a vent opening through said external wall.

12. The self-closing venting system of claim 10 wherein said screen comprises a plurality of walls defining a honeycomb structure.

13. The self-closing venting system of claim 12 wherein said plurality of walls are formed of 3 mil stock aluminum and define hexagonal cells which are open through said screen from front to back.

14. The self-closing venting system of claim 13 wherein said screen is substantially ⅝th inches thick and said hexagonal cells are substantially ¼ inch in cross-section.

15. The self-closing venting system of claim 10 wherein said vent opening extends from the exterior of said building into one of the group comprising a crawl space, a joist cavity between floors of said building, and an attic.

16. The self-closing venting system of claim 10 wherein the peripheral shape of said frame comprises a decorative figure.

17. The self-closing venting system of claim 16 wherein said decorative figure comprises one of the group of rectangle, square, oval, hexagon, octagon, circle, and star.

18. The self-closing venting system of claim 10 wherein said external wall comprises an eave and said self-closing vent is attached to a soffit.

19. The method of preventing the entrance of an external fire through the vents of external walls of a building, comprising the steps of:

providing a building with external walls;

forming at least one vent opening through said external walls; and covering said vent opening with a self-closing vent, said self-closing vent comprising:

a frame, said frame being dimensioned to fit said vent opening;

a screen, said screen being contained by said frame; and said screen being covered with an intumescent material.

20. The method of claim 19 further comprising:

replacing an existing external vent with said self-closing vent.

* * * * *